US006219010B1

(12) United States Patent
Chieusse et al.

(10) Patent No.: US 6,219,010 B1
(45) Date of Patent: Apr. 17, 2001

(54) ELASTICALLY DEFORMABLE ANTENNA REFLECTOR FOR A SPACECRAFT

(75) Inventors: Nathalie Chieusse, Aubergenville; Christophe Prud'hon, Rueil Malmaison; Guillaume Cautru, Poses; Alain Noir, Courbevoie, all of (FR)

(73) Assignee: Aerospatiale Societe Nationale Industrielle, Paris (FR)

( * ) Notice: Subject to any disclaimer, the term of this patent is extended or adjusted under 35 U.S.C. 154(b) by 0 days.

(21) Appl. No.: 09/345,751

(22) Filed: Jul. 1, 1999

(30) Foreign Application Priority Data

Jul. 2, 1998 (FR) ..... 98 08447

(51) Int. Cl.[7] ..... H01Q 15/20
(52) U.S. Cl. ..... 343/915; 343/DIG. 2
(58) Field of Search ..... 343/915, 912, 343/DIG. 2, 880, 881, 868, 914

(56) References Cited

U.S. PATENT DOCUMENTS 3,521,290 7/1970 Bahiman et al. .
4,133,501 1/1979 Pentlicki .
4,926,181 5/1990 Stumm .
5,574,472 11/1996 Robinson .
5,644,322 7/1997 Hayes et al. .

FOREIGN PATENT DOCUMENTS 0534110 3/1993 (EP) .
0749177 * 12/1996 (EP) .

OTHER PUBLICATIONS

Patent Abstracts of Japan, vol. 9, No. 208 (E–338), Aug. 24, 1985, 1985 and JP 60072305A (Nippon Denshin Denwa Kosha), Apr. 24, 1985.
Patent Abstracts of Japan, vol. 14, No. 241, (E–0931), May 22, 1990, and JP 02065508A (Toshiba Corp.), Mar. 6, 1990.

* cited by examiner

*Primary Examiner*—Tan Ho
*Assistant Examiner*—Ephrem Alemu
(74) *Attorney, Agent, or Firm*—Stevens, Davis, Miller & Mosher, LLP

(57) ABSTRACT

An antenna reflector for a spacecraft, produced in an elastically deformable way and capable of changing from a folded position to a deployed position at least partly under the action of its own elasticity. The reflector includes at least one fold line, the general direction of which is at least approximately parallel to the axis of the casing and about which said reflector is folded in its folded state.

9 Claims, 3 Drawing Sheets

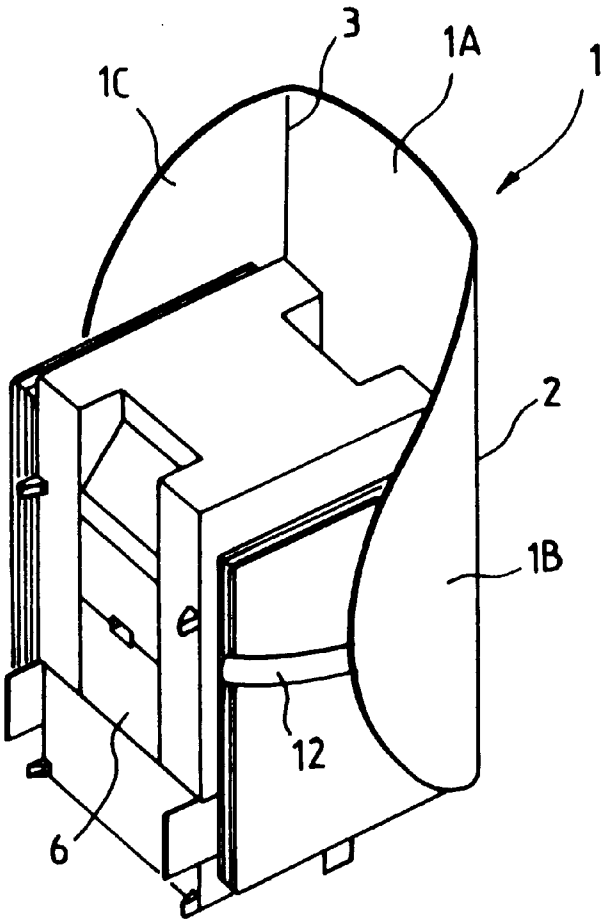
FIG. 5
FIG. 4
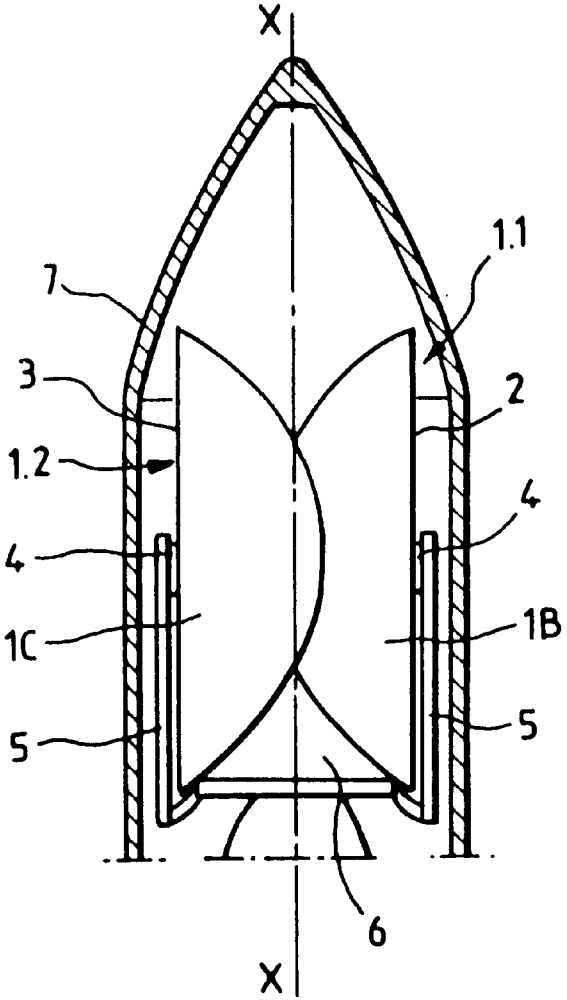

ELASTICALLY DEFORMABLE ANTENNA REFLECTOR FOR A SPACECRAFT

BACKGROUND OF THE INVENTION

The present invention relates to an elastically deformable antenna reflector for a spacecraft, such as an artificial satellite or space probe.

It is known that the items of equipment, such as the antennas, solar panels, etc, associated with a spacecraft have to be able to be folded in order to be able to be accommodated in a launch vehicle (rocket, shuttle) and to be deployed after ejection out of said launch vehicle, so as to take up their operational configuration.

DESCRIPTION OF THE PRIOR ART

It is known, moreover, that such equipment has already been produced in such a way that it is elastically deformable, this equipment then being able to take up either a deployed state, or a folded state, elastically deformed. By way of example, mention may be made of:

- the U.S. Pat. No. 3,521,290, which describes an antenna reflector in a single piece of an elastically deformable material provided with a rigid central base to which are linked a plurality of radial ribs integral with the convex face of said reflector and elastically articulated to said central base. Thus, said antenna reflector can take up a position folded into the shape of a tulip, which does not risk entailing permanent deformation of said reflector, and the change from the folded position into the deployed position in the shape of a concave disk can be carried out under the action of the elastic energy stored during the folding of the antenna structure. Controllable retaining means, consisting of a belt with pyrotechnic bolts, surrounding said folded reflector and arranged on the side opposite said central base, are provided in order to hold said reflector and said radial ribs in folded position under stress;
- the U.S. Pat. No. 4,133,501, which describes a solar panel for a spacecraft produced in a single elastically deformable piece in order to be able to take up either a curved, folded position under stress for which said solar panel matches the convex outer surface of said spacecraft, or a flat, deployed position, clear of said outer surface, the change from the curved, folded position to the flat, deployed position being due to the elastic relaxation of said solar panel. In curved, folded position, the solar panel is held against the outer surface of said spacecraft by latches, carried by this surface; and
- the U.S. Pat. No. 4,926,181, which describes a single-piece antenna reflector of an elastically deformable material, which can be rolled into a cylindrical shape and held in this shape by clamps. An underlying pliable structure can be deployed, in order to serve as a support on which said reflector can unroll and take up its deployed, operating shape, under the action of its elastic relaxation;
- the U.S. Pat. No. 5,644,322, which describes an antenna reflector consisting of a central rigid base of large surface area, surrounded by a peripheral frustoconical ring, produced from an elastically deformable material. This prior document shows, moreover, that it is usual, for launching a spacecraft, to store it in an elongate casing, for example of cylindrical-conical shape, constituting, for example, the upper nosecone of the launch rocket, the reflector of the antenna or antennas of said spacecraft being arranged laterally with respect to the body of the latter in the peripheral space bounded between said body and said casing. Hence, by virtue of such a structure, the size of the reflector, within said cylindrical-conical casing, can be slightly reduced by temporarily elastically deforming said peripheral ring, said reflector than taking up the shape, at least approximately, of a bowl laterally enveloping said body. The reflector is kept in this bowl shape by a belt, loosening of which is controlled electrically and which surrounds said body and said reflector in the central region of said base, this belt folding said elastically deformable ring down onto said body, bearing on two diametrally opposite points of said ring. After ejection into space, said reflector can resume its operating position, by removal of said belt and elastic return of said peripheral ring to its elastically relaxed, stable, deployed position. It can easily be understood that, in such a device, the saving in size of said reflector in folded position, by comparison with the deployed position, is limited. This is because, due to the large diameter of said rigid central base, the lateral compression of the reflector can be applied only to the peripheral ring, such that the saving in the lateral size is relatively small. Moreover, it will be noted that, in folded position, the reflector of U.S. Pat. No. 5,644,322 is not held firmly, such that it is subject to the vibrations induced during the launch. This can result in difficulties of dynamic balancing and of damping of the vibration of said reflector, and even damage to the reflector or to its surrounding objects; and
- the U.S. Pat. No. 5,574,472 and the Patent EP-A-0 534 110 describe an antenna reflector in a single piece of an elastically deformable material, which can take up a bowl-shaped folded position with a rounded section by virtue of a controllably frangible tensile link arranged between two diametrally opposed points of the periphery of said reflector. It will be noted that, in this position folded into the bowl shape, the reflector, because of its relative rigidity, cannot follow the lateral contour of said body as closely as it might. It results therefrom that the size of the reflector in folded position cannot be optimal. Moreover, it will be noted that the tensile link constitutes an obstacle, or at least an impediment, in arranging the body of the spacecraft in the concave space of the reflector in folded position, and that the production of said reflector in a single piece allows neither precise control of the shape of the reflector in folded position, nor optimal enveloping of the body of the spacecraft.

SUMMARY OF THE INVENTION

The object of the present invention is to remedy these drawbacks, and to allow said antenna reflector to envelope said body of the spacecraft as well as possible, and thus minimize the peripheral size of said reflector, while best controlling the shape and the vibrations of the reflector in folded position.

To this end, according to the invention, the antenna reflector for a spacecraft having to be stored in a casing of elongate shape along an axis, in such a way that said reflector is arranged laterally with respect to the body of said spacecraft, in the peripheral space bounded between said body and said casing, said reflector being elastically deformable in such a way that:

- outside said casing, said reflector can take up a stable, deployed state without elastic stress, corresponding to its functional shape;

within said casing, said reflector, by elastic folding around said axis of the casing, can take up a folded state allowing it laterally to envelop said body, said reflector being held in this folded state by virtue of controllable retaining means; and the change by said reflector from its folded state to its deployed state being due at least in part to the release of the energy stored in said reflector when it is elastically folded in order to make it change from its deployed state to its folded state, is noteworthy in that said reflector includes at least one fold line, the general direction of which is at least approximately parallel to said axis of the casing and about which said reflector is folded into its folded state.

Moreover, in accordance with another important feature of the present invention, provision is made for said controllable retaining means to fasten said reflector firmly to the body of said spacecraft.

It is thus easily seen that, according to the present invention, the abovementioned problems of peripheral size and of vibration are solved. This is because, by virtue of said fold line or lines, it is possible to obtain sharp angles of fold which allow said reflector to match the lateral contour of said body as well as possible (particularly if the latter is of rectangular parallelepipedal form as is usual), while said controllable retaining means largely eliminate the characteristic vibrations of said reflector. It will be noted, moreover, that said fold lines stiffen the reflector, participating in reducing said vibrations.

By comparison with the prior art reiterated above, it is thus seen that:

the first particular feature of the present invention consisting in producing said elastically deformable reflector in at least two parts linked by a fold line makes it possible:

to increase the accommodation capacity in said casing;

better to control the shape of the reflector in folded position, by concentrating the major part of the elastic deformation in limited folding areas;

the second particular feature of the present invention consisting in fixing said reflector in folded position on the body of said spacecraft makes it possible:

better to control the vibration of said reflector in folded position;

better to control the shape of said reflector in folded position;

to use retaining mechanisms known for other uses.

Particularly when the body of said spacecraft is of rectangular parallelepipedal shape, it is advantageous for said antenna reflector to include two parallel fold lines, delimiting an intermediate part and two lateral parts. Hence, in folded position of said reflector, said intermediate part can be applied against one face of said spacecraft body, while each lateral part of the reflector can be folded against an adjacent lateral face of said body, leaving the upper and lower faces of the body completely free.

Advantageously, each fold line, consisting for example of a line of a lesser thickness of the reflector, when said reflector is folded about this line, stores sufficient elastic energy to make said reflector change spontaneously from its folded state to its deployed state, when it is released. On the other hand, in the case in which each fold line is not, or is barely, sufficiently elastic to unfold said reflector and ensure that it returns to its functional position, auxiliary elastic means may be provided, for example of the tension spring type, to make said reflector change from its folded state to its deployed state.

BRIEF DESCRIPTION OF THE DRAWINGS

The figures of the attached drawing will give a good understanding of how the invention can be produced. In these figures, identical references designate similar elements.

FIG. 4 illustrates a variant arrangement of the reflector under the nosecone of the launcher.

FIG. 5 diagrammatically illustrates a variant embodiment of the reflector in accordance with the invention, arranged around a satellite.

DESCRIPTION OF THE PREFERRED EMBODIMENTS

Figure 2:
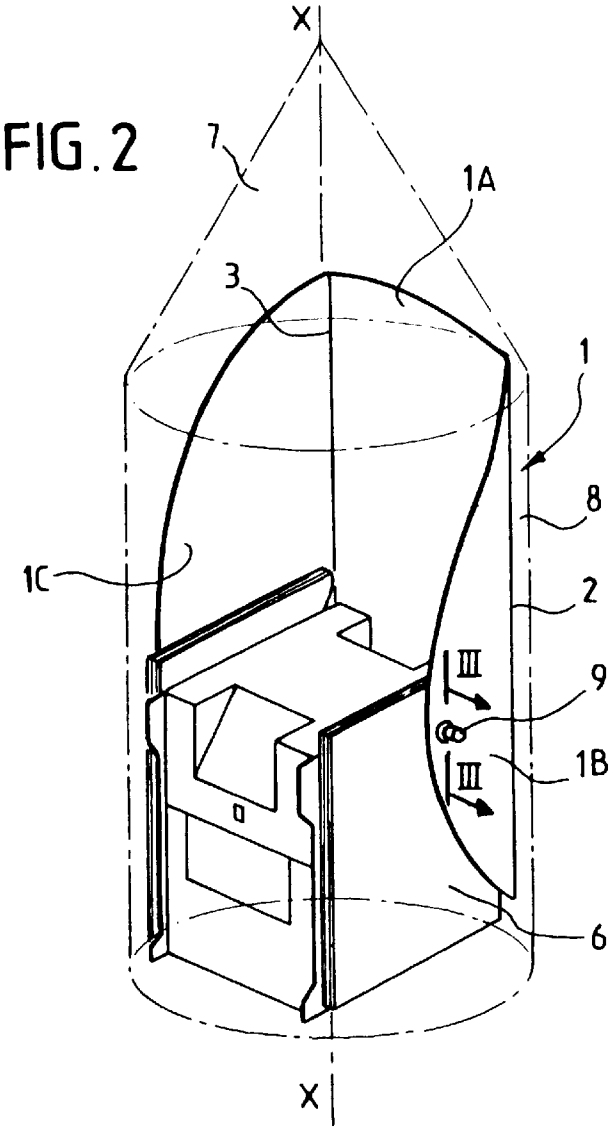
FIG. 2 diagrammatically shows the reflector in accordance with FIG. 1 arranged around a satellite, under the nosecone of a launcher.
Figure 1:
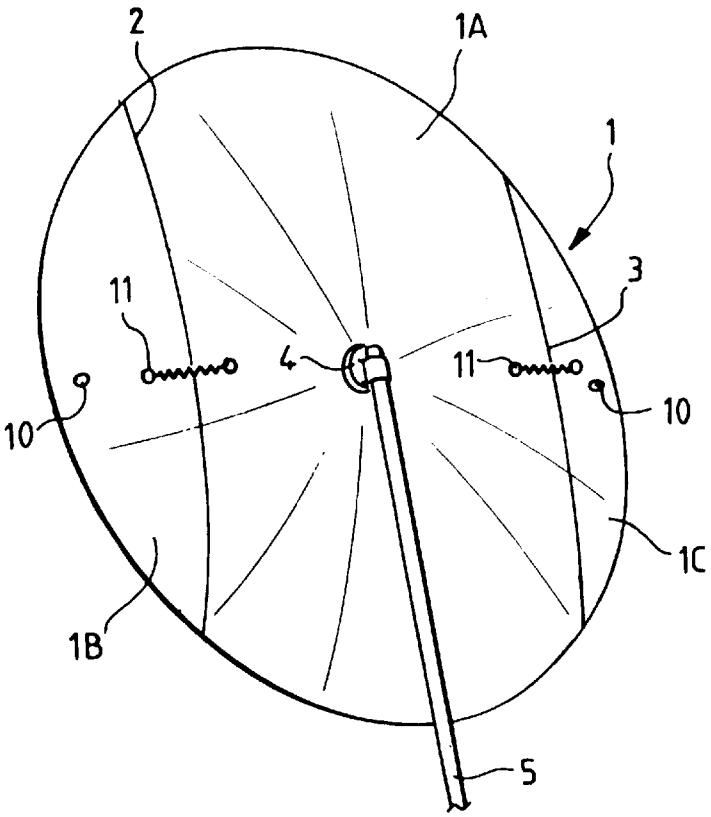
FIG. 1 is a view in diagrammatic perspective, from the rear, of an embodiment of the antenna reflector in accordance with the present invention, in deployed position.

The antenna reflector 1, in accordance with the present invention and illustrated diagrammatically in FIGS. 1 and 2, exhibits the shape, at least approximately, of a concave disk provided with two fold lines 2 or 3. These fold lines are parallel and they delimit, in said antenna reflector 1, an intermediate portion 1A and two lateral portions 1B and 1C.

The reflector 1 is produced from an elastically deformable material, for example as a fabric of carbon fibers, and said fold lines 2 and 3 may be formed by lines of lesser thickness of said reflector. If appropriate, stiffening rods (not represented) are arranged on the convex rear face of said reflector 1, outside said fold lines 2 and 3.

At the center of the reflector 1 there is a rigid base 4, linked on the rear side—that is to say on the convex side of said reflector—to a linking arm 5, of which the opposite end to said base 4 is intended to be articulated, in a way which is known and not represented, to the body of a spacecraft. In the example represented in FIG. 1, the inking arm 5 is parallel to the fold lines 2 and 3.

Hence, as FIG. 2 shows, the reflector 1 can take up a position folded about a spacecraft body 6 with discontinuity of curvature in the region of the fold lines 2 and 3. In this folded position, the intermediate portion 1A and the lateral portions 1B and 1C can be applied respectively against three consecutive lateral faces, adjacent pairwise, of said body 6.

As FIG. 2 diagrammatically illustrates, the reflector 1 can be stored in an elongate casing 7 with longitudinal axis X—X, for example the nosecone of a space launcher, the reflector 1 being arranged in the peripheral lateral space 8 bounded between the spacecraft body 6 and said casing 7 with its fold lines 2 and 3 parallel to said X—X axis. As is usual (not visible in FIG. 2 but visible in FIG. 4), the reflector 1 is linked to the spacecraft body 6 by the arm 5, which is articulated to the lower part of said body.

Figure 3A:
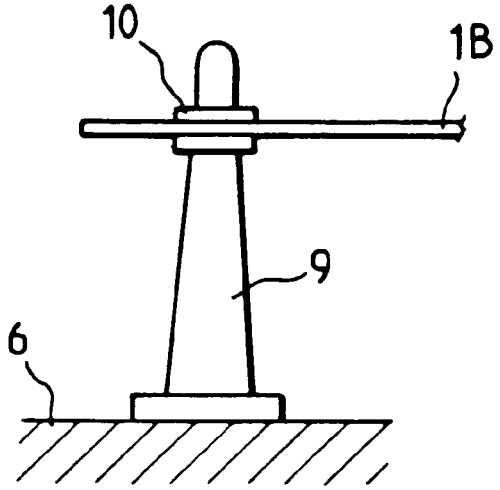
FIGS. 3A and 3B illustrate, in its locked and unlocked position respectively, a device for retaining said reflector of FIG. 2 on the body of said satellite, along the line III—III of this latter figure.

In the storage position of FIG. 2, the reflector 1 is, moreover, held by pyrotechnic studs 9, integral with the spacecraft body 6 and passing through eyelets 10 on the lateral reflector portions 1B and 1C (see FIG. 3A).

Figure 3B:
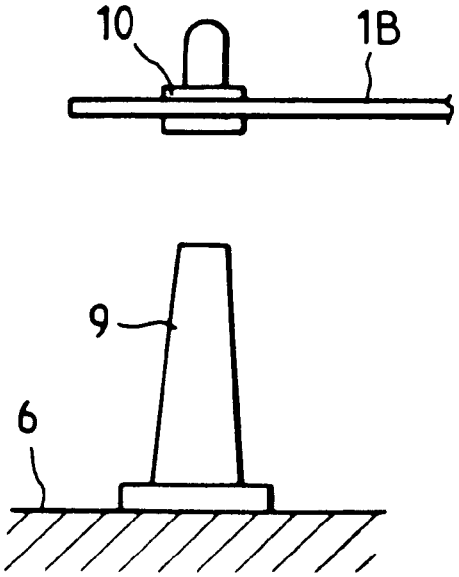

Hence, during the launch of the spacecraft, the reflector 1 is in the nosecone 7, as represented in FIG. 2, held rigidly in its shape folded about the fold lines 2 and 3. After said nosecone 7 is jettisoned and the spacecraft is ejected, the pyrotechnic studs 9 are activated and they release the reflector portions 1B and 1C from the body of the satellite 6 (see FIG. 3B). Next, the reflector 1 relaxes so as to take up its deployed state of FIG. 1, the arm 5 tilting (in a way which is known and not represented) so as to free said reflector from the body of the spacecraft 6.

It is advantageous for each fold line 2 and 3 to store sufficient elastic energy, when the reflector 1 is folded about the body of the spacecraft 6, to make said reflector change spontaneously from its folded state (FIG. 2) to its deployed state (FIG. 1), after release from the pyrotechnic studs 9.

In the event of this elastic energy stored in the fold lines 2 and 3 being insufficient, it is possible to provide auxiliary elastic means 11 assisting the deployment of said reflector. Such auxiliary elastic means 11 may include a tension spring, the action of which opposes the folding about the lines 2 and 3.

Illustrated in FIG. 4 is the storage of two reflectors 1, designated respectively by the references 1.1 and 1.2, about the spacecraft body 6. These two reflectors 1.1 and 1.2 are opposite one another with respect to said body 6, with the lateral portion 1B of the one integrated with the lateral wall 1C of the other.

In the variant embodiment of FIG. 5, the reflector 1, on its lateral portions 1B and 1C, exhibits external extensions 12 capable of serving for fixing onto the body 6. In all embodiments with two opposed reflectors (as shown in FIG. 4), it is possible for the forces to be taken up and for one reflector to be held on the other.

What is claimed is:

1. An antenna reflector for a spacecraft having to be stored in an elongate casing along an axis (X—X) such that said reflector is arranged laterally with respect to the body of said spacecraft, in the peripheral space bounded between said body and said casing, said reflector being elastically deformable such that:

outside said casing said reflector takes up a stable, deployed state without elastic stress, corresponding to its functional shape;

within said casing, said reflector, by elastic folding around said axis of the casing, is arranged in a folded state allowing said reflector to envelop said body laterally, said reflector being held in said folded state by a controllable retaining means; and said reflector changing from said folded state to a deployed state at least in part from the release of the energy stored in said reflector when it is elastically folded in order to change said reflector from said deployed state to said folded state, wherein said reflector includes at least one marked fold line having a general direction which is at least approximately parallel to said axis of the casing and about which said reflector is folded into said folded state in order to obtain sharp angles of fold for allowing said reflector to match as well as possible the lateral contour of said body.

2. The antenna reflector as claimed in claim 1, which includes two parallel fold lines delimiting an intermediate part and two lateral parts.

3. The antenna reflector as claimed in claim 1, wherein each fold line stores sufficient elastic energy, so that when said reflector is arranged in said folded state, said reflector changes spontaneously from said folded state to said deployed state when it is released.

4. The antenna reflector as claimed in claim 1, wherein auxiliary elastic means are associated with each fold line, in order to make said reflector change from said folded state to said deployed state.

5. The antenna reflector as claimed in claim 1, wherein said controllable retaining means are integral with the body of said spacecraft.

6. The antenna reflector as claimed in claim 1, wherein at least one lateral portion of said reflector includes an external fixing extension.

7. The antenna reflector according to claim 1, wherein said at least one marked fold line has a lesser thickness than that of said reflector.

8. The antenna reflector according to claim 7, wherein said at least one marked fold line is produced by an elastically deformable material.

9. The antenna reflector according to claim 8, wherein said elastically deformable material comprises carbon fibers.

* * * * *